US006996875B2

(12) United States Patent
Chiang

(10) Patent No.: US 6,996,875 B2
(45) Date of Patent: Feb. 14, 2006

(54) SECURING DEVICE FOR A WINDOW

(75) Inventor: Fanny Chiang, Taichung (TW)

(73) Assignee: Door & Window Hardware Co., Taichung (TW)

( * ) Notice: Subject to any disclaimer, the term of this patent is extended or adjusted under 35 U.S.C. 154(b) by 73 days.

(21) Appl. No.: 10/751,426

(22) Filed: Jan. 6, 2004

(65) Prior Publication Data

US 2005/0144756 A1 Jul. 7, 2005

(51) Int. Cl.
*E05F 5/02* (2006.01)

(52) U.S. Cl. ..... 16/82; 16/71; 16/DIG. 17; 248/279.1; 248/286.1; 49/394; 49/356; 403/59

(58) Field of Classification Search ..... 16/82, 16/2.1, 2.5, 71, DIG. 39, DIG. 17; 248/279.1, 248/286.1, 454; 49/394, 354, 356, 357, 468; 403/59, 119

See application file for complete search history.

(56) References Cited

U.S. PATENT DOCUMENTS

| | | | | |
|---|---|---|---|---|
| 2,456,505 | A * | 12/1948 | Hastings | 403/59 |
| 2,727,776 | A * | 12/1955 | Brownlee et al. | 292/276 |
| 3,424,280 | A * | 1/1969 | Hettich | 188/67 |
| 3,810,462 | A * | 5/1974 | Szpur | 600/234 |
| 4,182,079 | A * | 1/1980 | Hederus | 49/354 |
| 4,368,997 | A * | 1/1983 | Shemtov | 403/59 |
| 6,062,650 | A * | 5/2000 | Smith et al. | 299/1.4 |
| 6,101,675 | A * | 8/2000 | Goldstein | 16/94 D |
| 6,102,854 | A * | 8/2000 | Cartier et al. | 600/228 |
| 6,273,853 | B1 * | 8/2001 | Cartier et al. | 600/229 |
| 6,390,424 | B1 * | 5/2002 | Kidushim et al. | 248/122.1 |
| 6,736,364 | B2 * | 5/2004 | Oddsen, Jr. | 248/585 |

FOREIGN PATENT DOCUMENTS

JP 2004360291 A * 12/2004

* cited by examiner

*Primary Examiner*—Brian E. Glessner
*Assistant Examiner*—Mark Williams
(74) *Attorney, Agent, or Firm*—Rosenberg, Klein & Lee

(57) ABSTRACT

A securing device for a window includes a fixed support, a slide rod pivoted to the window and displaceably passed through a transverse hole of the fixed support, and a knob screwed into an axial screw hole of the fixed support for securing the slide rod after the window is moved to an intended position; a pair of curved pads is used for protecting the slide rod from scratching of the fixed support; each pad has a curved main body with convex and concave sides, an engaging protrusion on the convex side, and several ribs formed around and connected to the engaging protrusion; the pads are respectively positioned in the axial hole, and the fitting cavity with the concave sides facing each other, and with the ribs being pressed against inner sides of the fixed support for preventing the pads from falling off.

1 Claim, 5 Drawing Sheets

SECURING DEVICE FOR A WINDOW

BACKGROUND OF THE INVENTION

1. Field of the Invention

The present invention relates to a securing device for an angularly displaceable window, which includes a fixed support, a slide rod pivoted to the window and displaceably passed through the fixed support, and a knob screwed into the fixed support for securing the slide rod in position after the window is moved to an intended position, more particularly one, which is equipped with a pair of easy-to-fit curved pads in the fixed support for preventing scratches from being formed on the slide rod when the rod is moved relative to the fixed support.

2. Brief Description of the Prior Art

Besides common functions such as allowing sun and air to pass into a room, windows can be provided with decorative functions. Among all kinds of windows, angularly displaceable ones can be moved to such an open position that the room is provided with a bigger opening for allowing more sunlight and air to pass into the room. And, an angularly displaceable window can be moved to any position according to the user's needs therefore it is very convenient to use.

Referring to FIGS. 5 and 6, a conventional securing device is provided to an angularly displaceable window, which device includes a fixed support body 1, a knob 13, and a slide rod 2. The fixed body 1 is fixedly disposed near to the window, and has an axial hole 12, a transverse through hole 11 communicating with the axial hole 12, and screw threads around the axial hole 12 on an inner side. The slide rod 2 is pivoted to the window at one end, and passed through the transverse through hole 11 of the fixed body 1. And, a stopping block 22 is joined to the other end of the slide rod 2 for preventing the rod 2 from falling out of the fixed body 1. The knob 13 is screwed into the axial hole 12 of the fixed body 1.

Thus, when the window is angularly displaced for adjustment of position, the slide rod 2 will move relative to the fixed body 1, and the window will be stopped from moving beyond a completely open position where the stopping block 22 comes into contact with the fixed support body 1. After the window is moved to an intended position, the knob 13 is screwed further into the fixed body 1 to secure the slide rod 2 to the fixed body 1 for preventing the window from moving.

However, because there is no protection for the slide rod 2, the slide rod 2 will come into contact with the edge of the transverse through hole 11, and scratches are prone to form on the same while the window is being angularly displaced between the completely open position and the closed one. Consequently, rust is prone to form on the slide rod, which will make the slide rod unpleasant to look at and unable to move smoothly relative to the fixed body 1.

SUMMARY OF THE INVENTION

It is a main object of the present invention to provide a securing device for a window to overcome the above disadvantage.

The securing device of the present invention includes a fixed support, a slide rod pivoted to the window and displaceably passed through a transverse hole of the fixed support, and a knob screwed into an axial screw hole of the fixed support for securing the slide rod after the window is moved to an intended position. Furthermore, a pair of curved pads is used for protecting the slide rod from scratching of the fixed support; each pad has a curved main body with convex and concave sides, an engaging protrusion on the convex side, and several ribs formed around and connected to the engaging protrusion. The pads are respectively fitted in the axial hole, and the fitting cavity with the concave sides facing each other, and with the ribs being pressed against inner sides of the fixed support for preventing the pads from falling off.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
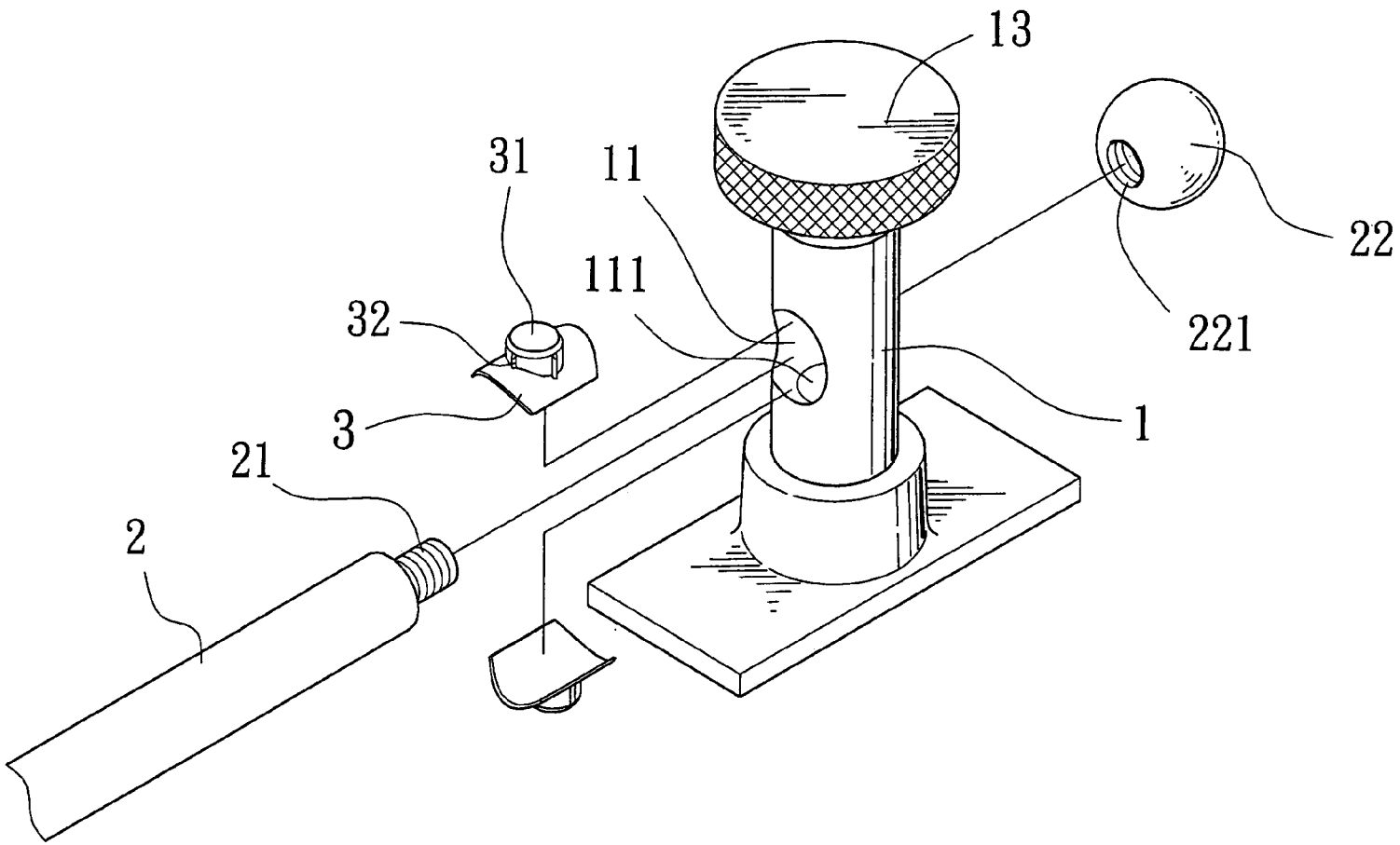
FIG. 1 is an exploded perspective view of the securing device for a window according to the present invention.
Figure 2:
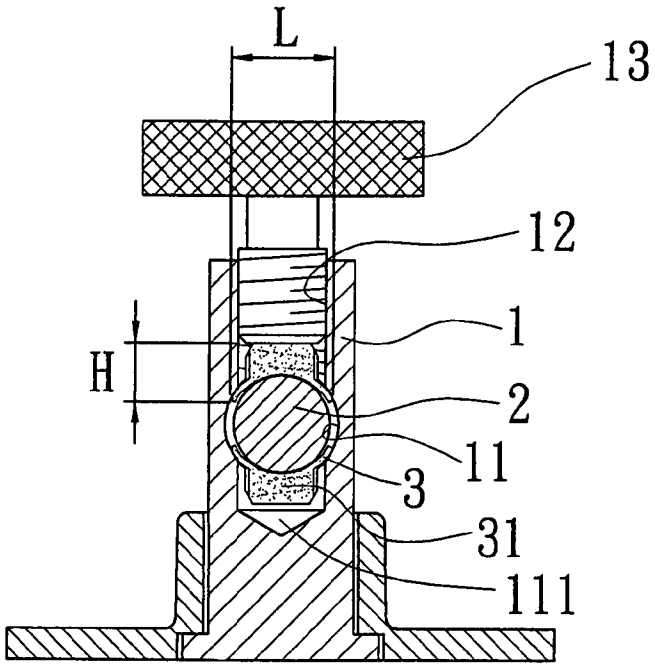
FIG. 2 is a cross-sectional view of the securing device for a window according to the present invention.

Referring to FIGS. 1 and 2, a securing device of the present invention is provided for use with an angularly displaceable window 4 (FIG. 3), which device includes a fixed support body 1, a slide rod 2, a pair of curved pads 3, and a knob 13.

Figure 3:
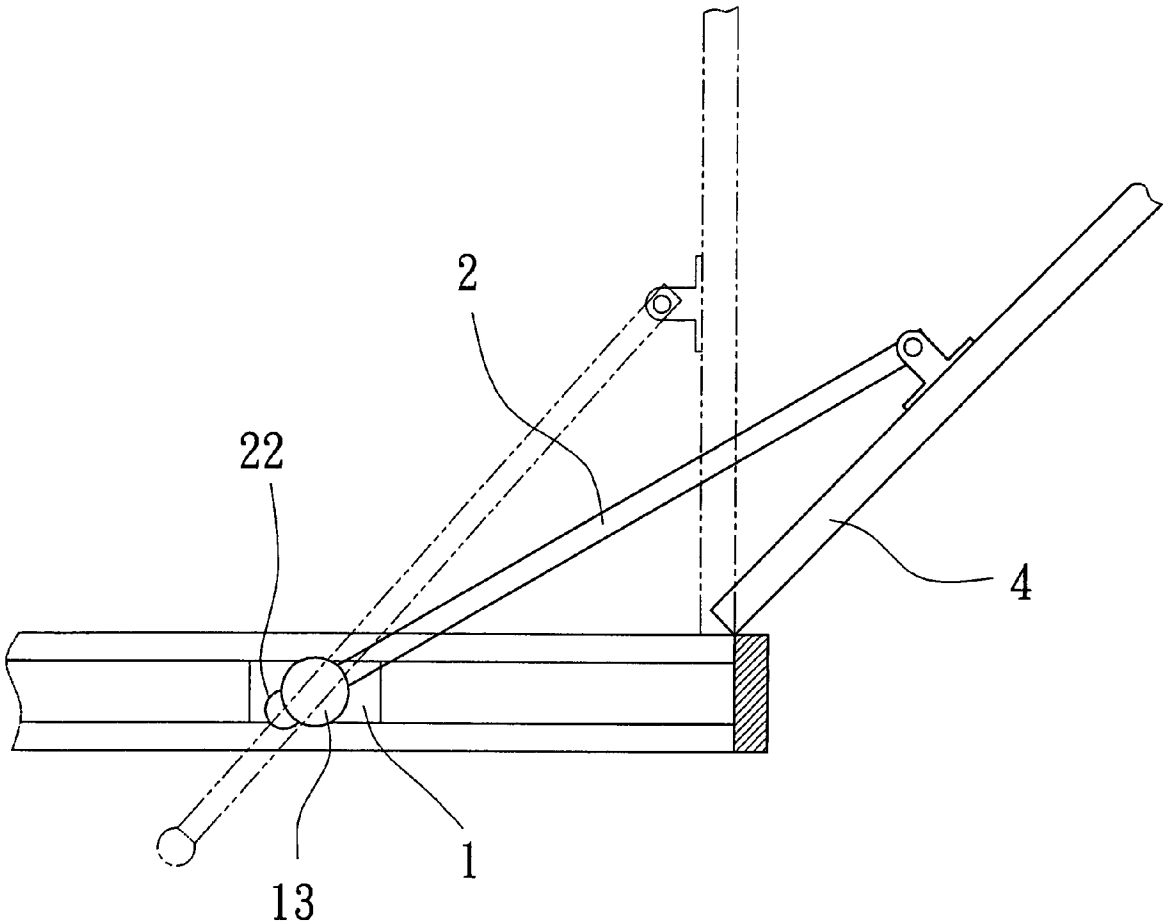
FIG. 3 is a top view of the securing device of the present invention joined to a window for use.
Figure 5:
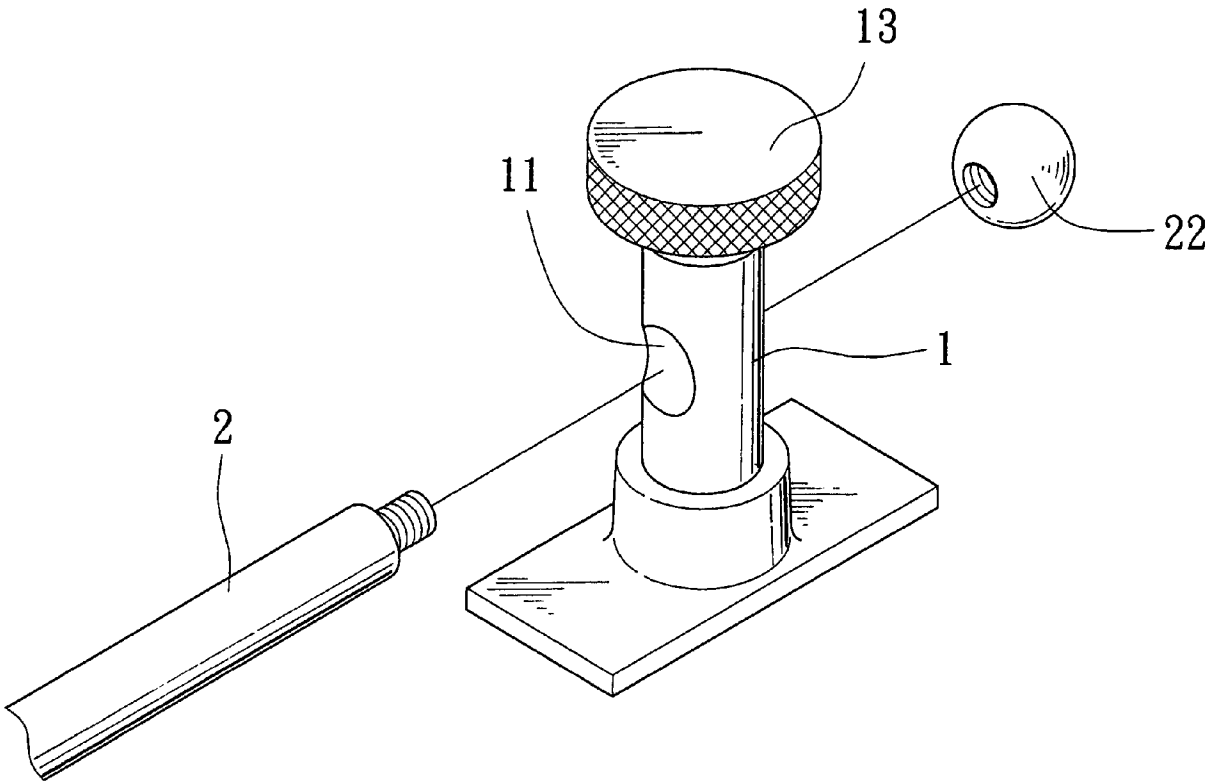
FIG. 5 (PRIOR ART)
FIG. 5 is an exploded perspective view of the conventional securing device for a window as described in the Background.
Figure 6:
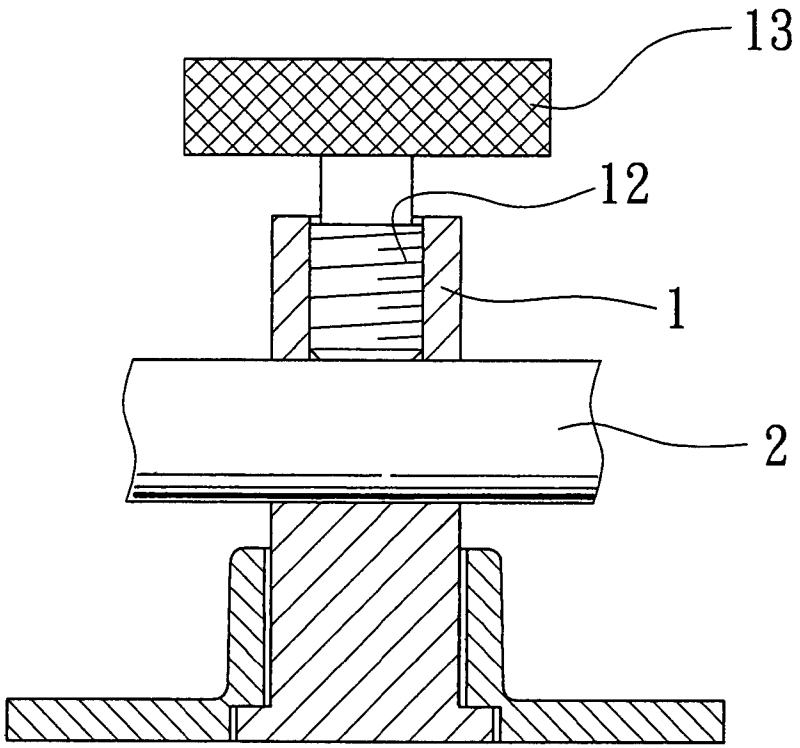
FIG. 6 (PRIOR ART)
FIG. 6 is a cross-sectional view of the conventional securing device.

Referring to FIG. 3 as well, the fixed body 1 is fixedly disposed near to the window, and has an axial screw hole 12, a transverse through hole 11 communicating with the axial screw hole 12, a fitting cavity 111 adjacent to the transverse through hole 11 and right opposite the axial hole 12. The knob 13 is screwed into the axial screw hole 12 of the fixed support body 1.

Each of the curved pads 3 has a curved main body with convex and concave sides, an engaging protrusion 31 on the convex side, and several ribs 32 formed around and connected to the engaging protrusion 31. The engaging protrusions 31 of the curved pads 3 are respectively positioned in the axial screw hole 12, and the fitting cavity 111 of the fixed body 1 via the transverse hole 11 with the concave sides thereof facing each other, and with the ribs 32 being pressed against the inner sides of the fixed support body 1; thus, the curved pads 3 can't fall out of the fixed support body 1 easily.

The slide rod 2 is pivoted to the window 4 at one end, and passed through the transverse through hole 11 of the fixed body 1. And, a stopping block 22 is used for preventing the slide rod 2 from separating from the fixed body 1. The stopping block 22 has a hole 221 as well as screw threads around the hole 221 on an inner side thereof, and is screwed onto other end 21 of the slide rod 2, which is formed with screw threads on an outer side.

Figure 4:
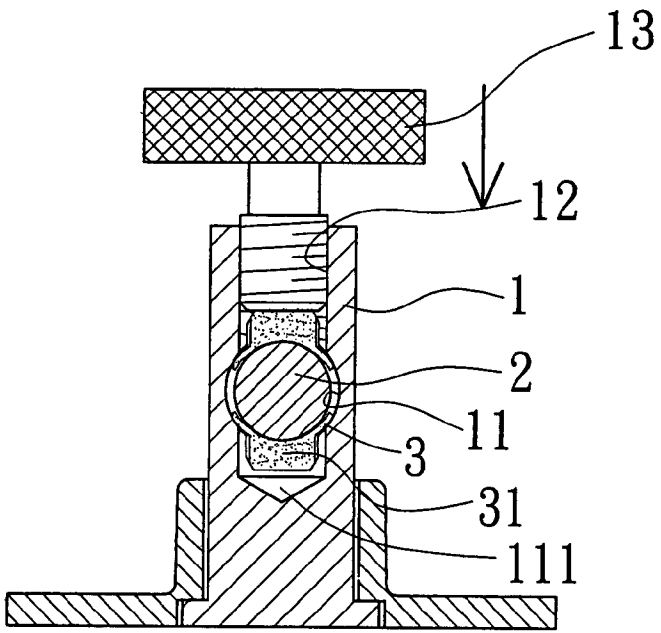
FIG. 4 is a cross-sectional view of the securing device of the present invention, in the securing position.

Thus, referring to FIG. 3, when the window is angularly displaced for adjustment of position, the slide rod 2 will move relative to the fixed body 1, and the window will be stopped from moving beyond a completely open position where the stopping block 22 comes into contact with the fixed support body 1. And, the curved pads 3 prevent the slide rod 2 from touching the fixed support body 1 with the concave sides thereof abutting the slide rod 2, as shown in FIG. 2. Consequently, the slide rod 2 won't touch the edges of the transverse hole 11, and scratches won't be formed on the slide rod 2 when the window is displaced between the completely open position and the closed one for adjustment. After the window is moved to an intended position, the knob 13 is screwed further into the fixed body 1 such that the curved pads 3 firmly hold the slide rod 2 in position as shown in FIG. 4, and the window is secured in the intended position.

In addition, referring to FIG. 2, L, the width of each curved pad 3, is smaller than the diameter of the slide rod 2 such that the curved pads 3 can protect the slide rod 2 from scratching effectively. And, H, the height of each curved pad 3, i.e. the vertical distance from the top of the engaging protrusion 31 to the lower end of the curved main body, is smaller than one half of the diameter of the transverse hole 11 so that the curved pads 3 can be easily positioned in the fixed body 1 via the transverse hole 11.

From the above description, it can be easily understood that the securing device of the present invention has advantages as followings:

1. The slide rod 2 is protected from scratching of the fixed support body 1 by the curved pads 3. And, the curved pads 3 can be easily fitted in the fixed body 1. Furthermore, because the ribs 32 are pressed against the inner sides of the fixed support body 1, the curved pads 3 can be held in position in the assembling process of the securing device.
2. Because the curved pads 3 are respectively held steady in the hole 12, and the cavity 111, the slide rod 2 can be easily passed through the transverse hole 11 in the assembling process. And, with the help of the engaging protrusions 31, the curved pads 3 can't fall out of the fixed support body 1 when the slide rod 2 is being displaced.

What is claimed is:

1. A securing device for a window, comprising:

a support body fixed in position; the support body having an axial screw hole, and a transverse through hole communicating with the axial screw hole; the support body having a fitting cavity adjacent to the transverse through hole and communicating with the axial screw hole;

a slide rod having a first end adapted to be pivoted to the window and displaceably passed through the transverse through hole of the fixed support body; a stopping block being screwed onto a threaded second end of the slide rod for preventing the rod from separating from the fixed support body;

a knob screwed into the axial screw hole of the support body for securing the slide rod in position after the window has been moved to an intended position; and a pair of curved pads for protecting the slide rod from scratching of edges of the transverse through hole; each curved pad having a curved main body with convex and concave sides, an engaging protrusion on the convex side, and a plurality of ribs formed around and connected to the engaging protrusion; the curved pads being respectively positioned in the axial screw hole and the fitting cavity of the support body, the concave sides of the curved pads facing each other; the curved pads being held in position with the ribs being pressed against inner sides of the support body; a width of the curved pads being smaller than a diameter of the slide rod; a vertical distance from a top of the engaging protrusion of each curved pad to a lower edge of the curved main body being smaller than one half of a diameter of the transverse through hole.

* * * * *